United States Patent [19]

Ewig

[11] Patent Number: 4,491,262

[45] Date of Patent: Jan. 1, 1985

[54] ELECTRO-MAGNETIC STAPLING TOOL

[75] Inventor: John F. Ewig, Worcester, Mass.

[73] Assignee: Parker Manufacturing Company, Worcester, Mass.

[21] Appl. No.: 416,647

[22] Filed: Sep. 10, 1982

Related U.S. Application Data

[63] Continuation-in-part of Ser. No. 148,721, May 12, 1980, Pat. No. 4,349,143.

[51] Int. Cl.[3] ..... B25C 1/00

[52] U.S. Cl. ..... 227/131; 227/129; 227/110; 310/30

[58] Field of Search ..... 227/131, 110, 129; 173/117, 122; 310/14, 23, 30, 34, 35; 318/114

[56] References Cited

U.S. PATENT DOCUMENTS 3,345,546 10/1967 Beltramo ..... 227/131 X

FOREIGN PATENT DOCUMENTS 2754641 6/1979 Fed. Rep. of Germany ..... 227/131

*Primary Examiner*—E. R. Kazenske

*Assistant Examiner*—Willmon Fridie, Jr.

*Attorney, Agent, or Firm*—Thompson, Birch, Gauthier & Samuels

[57] ABSTRACT

An electro-magnetic stapling tool having a mechanism for adjusting the power with which the solenoid-operated plunger and the staple driver drive the staples. In its preferred embodiment, the power adjusting a mechanism includes a manually adjustable selector knob having a cam element, and includes a cam follower mounted in association with the upper end of the solenoid core. Rotation of the selector knob adjusts the length of the solenoid power stroke and the resulting driving power of the stapling tool.

4 Claims, 6 Drawing Figures

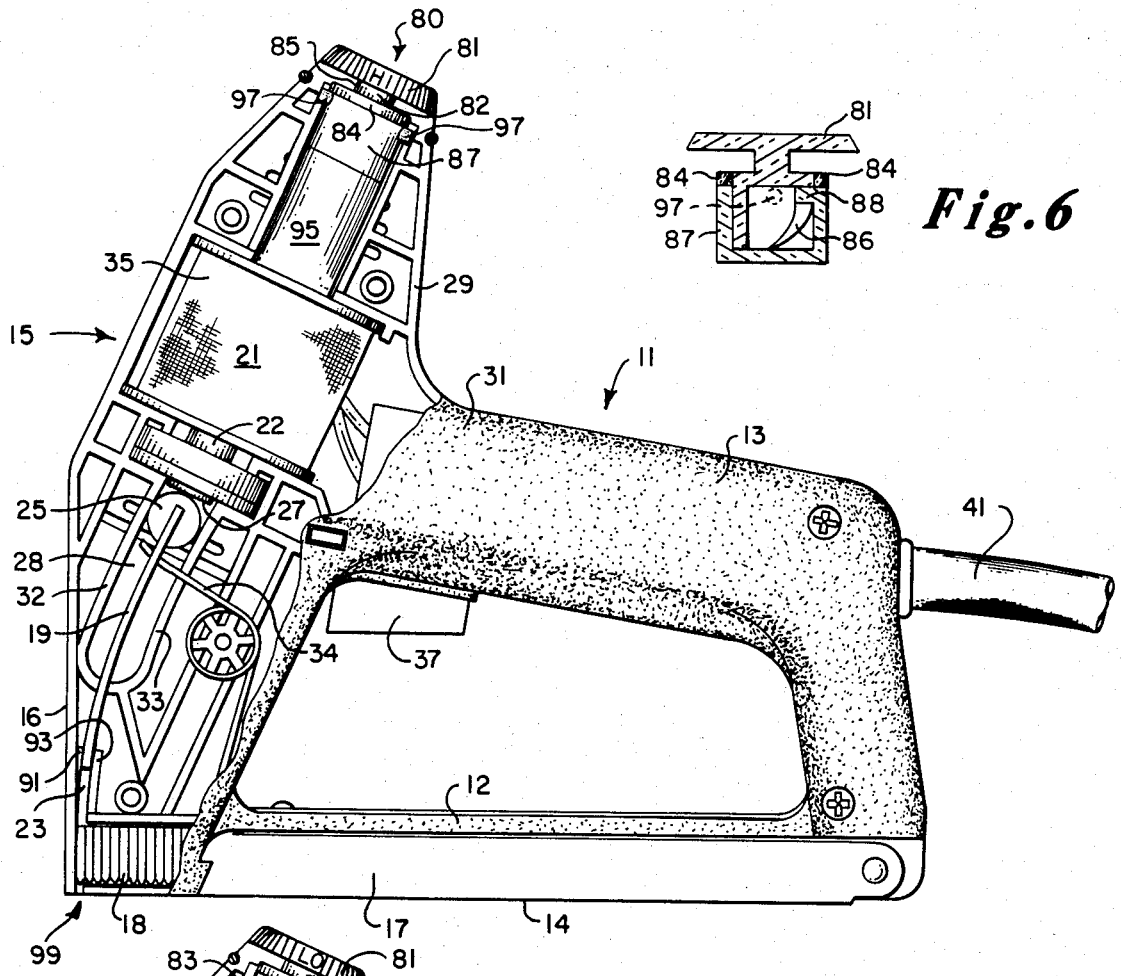
Fig.1
Fig.6
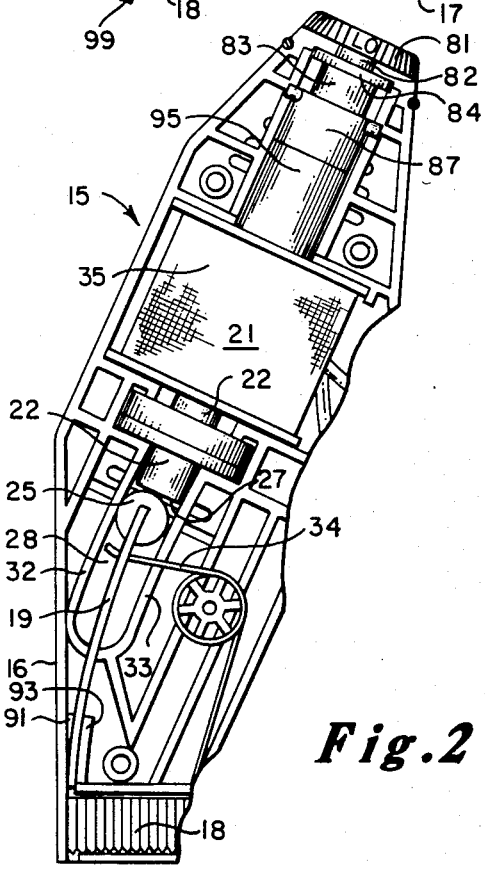
Fig.2
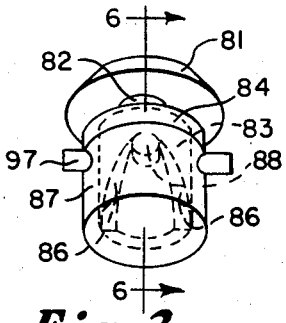
Fig.3
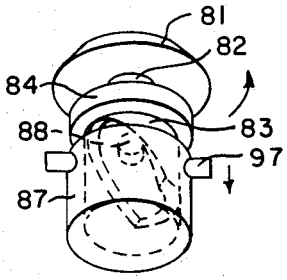
Fig.4
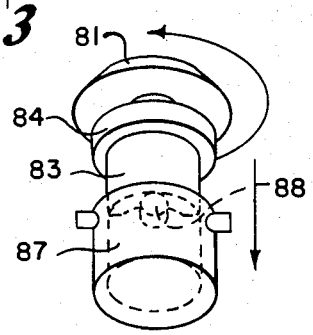
Fig.5

ELECTRO-MAGNETIC STAPLING TOOL

CROSS-REFERENCE TO RELATED APPLICATIONS

This is a continuation-in-part of my co-pending application Ser. No. 148,721 filed May 12, 1980, issued as U.S. Pat. No. 4,349,143 on Sept. 14, 1982.

BACKGROUND OF THE INVENTION

This is an improvement on my U.S. Pat. No. 4,349,143 issued Sept. 14, 1982. In that patent, provision was made for the stapling tool to have two power settings. The high setting produced relatively more power to drive the staples into hard materials, and the low setting produced relatively less power to keep from driving the staples through thin or soft material. In order to produce the high and the low power, the solenoid had two coils that could be jointly or singly energized. This permitted a selection between the high-force operation and the low-force operation.

Obviously, the use of two solenoid coils is a relatively expensive way to provide this selective power feature. It is the object of the present invention to permit the operator to select the high or the low power setting while using but a single coil which will reduce manufacturing costs and reduce tool size in comparison with the dual coil arrangement shown in my prior patent.

SUMMARY OF THE INVENTION

The electro-magnetic stapling tool of the present invention is generally described in my U.S. Pat. No. 4,349,143. All of the disclosure of that patent is incorporated herein and made a part of this disclosure. The features which are common between my prior patent and the present invention will not be described in detail. However, they will be described in general terms.

The stapling tool has a housing having a main body in which the power unit is located, a magazine portion in which the staples are located, and a handle in which the trigger, the electronic components, and the electric cord are located. The magazine portion has a flat bottom surface which is adapted to lie along the surface of the article to be stapled. The main body portion extends upwardly from the forward end of the magazine portion and has an end surface which lies substantially at a right angle to the bottom surface of the magazine portion. The main body end surface is the forward-most surface of the stapling tool.

A staple magazine is located in the magazine portion and includes spring-biased means for presenting staples seriatim to the magazine portion forward end.

An upwardly biased staple driver is mounted in a curved passage which is formed in the main body. The staple driver slidably reciprocates towards and away from the magazine portion forward end. The main body curved passage enters the front end of the magazine portion at a right angle to the bottom surface of the magazine portion.

A solenoid, which includes a fixed wire coil and a movable iron core, is mounted in the main body. A plunger is co-axially fixed to and extends downwardly from the core and moves with the core along a straight path which lies at an acute angle to the main body end surface. The lower end of the plunger remains in continuous contact with the upper end of the upwardly biased staple driver.

The principal feature of this invention is the improved means for adjusting the power with which the solenoid-operated plunger and the staple driver drive the staples. The preferred embodiment of the power-adjusting means includes a power selector knob mounted at the upper end of the main body which knob has a cam surface which interacts with a cam follower surface mounted in association with the upper end of the core. This cam arrangement selectively limits the upward travel of the core and, accordingly, the power of the stroke.

Alternative embodiments of the power adjusting means include a transverse pin with a cam mounted thereon, and a transverse pin which laterally moves along the axis of the main body. Both of the alternative embodiments limit the upward travel of the core.

BRIEF DESCRIPTION OF THE DRAWINGS

FIG. 1 is a side elevational view of the preferred embodiment of the electro-magnetic stapling tool of this invention with portions of the main body and the staple magazine portion cut away.

FIG. 2 is a side elevational view of the main body of the tool shown in FIG. 1, also partially cut away, showing the difference between the high power setting in FIG. 1 and the low power setting in FIG. 2.

FIG. 3 is a perspective view, with interior portions shown in phantom, of the power selector knob and its cam in engagement with the core crown and its cam follower. This figure shows the high power setting.

FIG. 4 is a similar perspective view of the power selector knob and core crown, but with the knob turned approximately 45°, causing the core crown (and the core) to move downward a short distance.

FIG. 5 is a similar perspective view of the power selector knob and core crown, with the power selector knob rotated approximately 180° from the FIG. 3 position, causing the core crown (and the core) to move downward the maximum distance to the low power setting.

FIG. 6 is a sectional view, taken along line 6—6 in FIG. 3, showing the cooperative relationship between the power selector knob and the core crown.

DESCRIPTION OF THE PREFERRED EMBODIMENT

Referring to FIG. 1, the electro-magnetic stapling tool has an overall housing 11 which consists of a main body 15, a magazine portion 12, and a handle 13. The magazine portion 12 is provided with a flat bottom surface 14 which is adapted to lie along the surface of the article into which a staple is to be driven. The main body 15 extends upwardly from the forward end 99 of the magazine portion 12. The main body has an end surface 16 lying at right angle to the bottom surface 14. The main body end surface 16 forms the forward-most surface of the stapling tool.

A staple magazine 17 is located in the magazine portion 12 and has spring-biased means (not shown) for presenting the staples seriatim to the magazine portion forward end 99.

A staple driver 19 is mounted in the main body 15 and has a sliding motion towards and away from the magazine portion forward end 99 for driving staples 18. The solenoid 21 is mounted in the main body 15 and has a single coil 35, and a iron core 95 which reciprocates within the coil in response to electrical energization of the coil. The iron core 95 has a plunger 22 co-axially fixed thereto and extending downwardly therefrom so that the core and the plunger reciprocate as a single unit along a straight path which lies at an acute angle to the main body end surface 16. Because the staple driver 19 is upwardly biased by spring 34, the plastic cylinder 25 at the upper end of staple driver 19 is maintained in continuous contact with the lower end 27 of the plunger.

The staple driver 19 is formed as a elongated metal band which is flexible. The main body 15 has a curved passage 23 which guides the lower end of the staple driver. The curved passage 23 extends down to and enters the forward end 99 of the magazine portion 12 so that an imaginary tangent at that point is parallel to the end surface 16 of the main body 15 (and perpendicular to the bottom surface 14), and the remainder of the curved passage 23 curves away from the end surface 16. The purpose of the plastic cylindrical head 25 mounted on the upper end of the staple driver 19 is to permit angular misalignment between the lower end of the plunger and the upper end of the staple driver. The staple driver flexes as it is driven along the curved passage 23 by the solenoid-driven plunger. The cylinder 25 has its axis transverse to the axis of the plunger. The plunger has a transverse flat surface 27 which contacts the cylindrical surface of the head 25.

The main body 15 is provided with a second passage 28 which has a rectangular cross-section and is sized to receive the head 25 in sliding relationship. This second passage 28 joins the first passage 23 but is much larger to accommodate the sliding movement of head 25.

Housing 11 consists of two substantially mirror-image halves 29 and 31. The straight second passage 28 is formed between ribs 32 and 33, and the curved first passage 23 is formed between the ribs 91 and 93. The spring 34 passes through a hole in and acts upwardly on the staple driver 19 to bias it continuously in the upward direction against the lower end 27 of the plunger.

The solenoid 21 has a single coil 35 and an iron core 95 which are telescopically mounted and are adapted to be energized through the use of a trigger switch 37 mounted in the handle 13. An electrical circuit (not shown) is mounted in the interior of the handle 13 and permits a single pulse of electrical current to reach the coil 35. A cable 41 is provided to connect the stapling tool to a source of 110 volt, alternating current electricity. The electrical circuit is completed when the finger switch 37 is depressed, and the solenoid is thereupon energized.

The foregoing describes the electro-magnetic stapling tool which is shown in my U.S. Pat. No. 4,349,142. The important feature of my new invention resides in the provision of an improved means for adjusting the power with which the solenoid-operated plunger and the staple driver drive the staples. Such an improved power adjusting means is specifically shown in FIGS. 3–6 of the drawings. In its shown preferred embodiment, the power adjusting means includes a power selector knob 80 which has a disk-shaped knob 81, a central stem 82, a cam element 83, and a soft elastic washer 84 surrounding the cam element 83. The knob 80 is mounted through an opening 85 formed in the main body 15 at its upper end. The cam element 83 acts as a locating element within the interior of the main body 15. The cam element 83 is rotated by the manually adjustable knob for the purpose of selectively limiting the upward stroke of the solenoid core. In the preferred embodiment, the opening 85 in the main body is in axial alignment with the axis of the core 95. Therefore, the power selector knob 80 rotates about an axis which is coaxial with the axis of the solenoid core. Preferably, the knob cam element 83 is formed as a hollow cylinder with a portion of one side of the cylinder cut off at an angle. This produces a cam surface 86 which rotates when the knob is rotated.

In order to cooperate with cam element 83, the solenoid core is provided with a core crown 87 which is fixed to the upper end of the core 95 and which is in the form of a cup having its bottom fitted flush with the top of the core so that adhesive or a bolt or other means can rigidly fasten the bottom of the core crown 87 to the top of the core 95. Within the interior of the core crown 87 is a cam follower 88 adapted to ride on the face of the cam element cam surface 86. The two shoulders 97 on the exterior of core crown 87 prevent the core crown (and the core from rotating about its axis.

Thus, when the knob 80 is turned to its high setting (see FIG. 1), the upwardly biased cam follower 88 moves upwardly to its uppermost high power position as shown in FIG. 3. This allows the solenoid to have a maximum core stroke length and to deliver maximum power to the plunger and the staple driver and the staples. In contrast, when the knob 80 is turned to its low setting (see FIG. 2), the cam follower 88 is cammed downwardly to its lowermost non-energized low power position as shown in FIG. 5. This position limits the core to the shortest possible stroke length resulting in the delivery of the lowest possible power to the plunger and the staple driver and the staples. The knob 80 can also be turned to intermediate settings (see FIG. 4) to allow the solenoid core to have an intermediate stroke length. By thus using the power selector knob to shorten or lengthen the solenoid core stroke, the amount of power generated by the solenoid is selectively modified.

In this manner, the power adjusting means of the present invention functions simply and easily with a single solenoid coil and with but two cam components, both of which are preferably made of plastic.

It will be appreciated that the purpose of the power adjusting means of this invention is to limit the upward travel of the iron core in a simple fashion. Although the preferred embodiment has been commercially successful, it is clear that other simple means might be substituted. Applicant shall now discuss two alternative embodiments in order to show other simple power adjusting means.

DESCRIPTION OF TWO ALTERNATIVE EMBODIMENTS

The first alternative embodiment of the power adjusting means includes the provision of an opening in the side of the main body 15 slightly above the upper end of the core. A pin extends through the opening and extends transversely across the upward path of the core. The pin has a cam coaxially mounted thereon in position to be continuously contacted by the upper end of the upwardly biased core 95.

The power selector knob 81 is affixed to that end of the pin which extends outwardly through the opening, and the selector knob has two positions (180° apart), one permitting the core to move upwardly a maximum distance to the low portion of the cam, the other permitting the core to move upwardly a minimum distance to the high portion of the cam. Of course, the selector knob could have additional positions or be infinitely adjustable.

The second alternative embodiment is the provision of a slot-shaped opening in the side of the main housing 15 which slot-shaped opening is oriented and built up to parallel the axis of core travel. A pin is inserted into the slot and extends transversely across the path of core travel. Gear wheels are fixed to the inside end of the pin and to a point near the other end of the pin (but within the main housing). The gear wheels ride in parallel tracks fixed on the inside walls of the main housing parallel to the stroke of the core. The pin extends across the path of the core and is contacted at its center by the upper end of the core. The outer end of the pin extends through the slot and is gripped by a power selector knob which can be rotated to move the pin in its tracks laterally up or down the bore of the main housing to limit the maximum stroke of the core.

It will be understood that both the preferred and the alternative embodiments of the power adjusting means accomplish the same purpose which is to selectively and adjustably prevent the core from moving upwardly to the maximum position when low power is desired, and to selectively permit the core to move upwardly to the maximum position when high power is desired.

The above description obviously suggests many possible variations and modifications of this invention which would not depart from its spirit and scope. It should be understood, therefore, that the invention is not limited in its application to the details of structure specifically described or illustrated and that, within the scope of the appended claims, it may be practiced otherwise than as specifically described or illustrated.

I claim:

1. In an electro-magnetic stapling tool having:

(a) a housing having a main body, a magazine portion, and a handle, said magazine portion having a flat bottom surface which is the bottom surface of said stapling tool and which is adapted to lie along the surface of an article to be stapled, said main body extending upwardly from the forward end of said magazine portion and having an end surface lying substantially at a right angle to said bottom surface, said main body end surface being the forward-most surface of said stapling tool;

(b) a staple magazine located in said magazine portion to present staples seriatim to said magazine portion forward end;

(c) an upwardly biased staple driver mounted in a curved passage of said main body for reciprocating sliding motion towards and away from said magazine portion forward end;

(d) a solenoid including a coil and reciprocally movable core mounted in said main body, a plunger coaxially fixed to and extending downwardly from said core for movement therewith along a straight path which lies at an acute angle to said main body end surface, the lower end of said plunger being maintained in continuous contact with the upper end of said upwardly biased staple driver;

(e) said curved passage of said main body in which said staple driver reciprocates extending downwardly to said forward end of said magazine portion and forming a right angle with said bottom surface of said magazine portion; and (f) means for adjusting the power with which said solenoid-operated plunger and said staple driver drive the staples, the improvement therein comprising:

(i) said main body having at least one opening formed at the upper end thereof in axial alignment with the axis of said core, said main body opening providing access from the main body exterior to said plunger/core assembly;

(ii) a manually adjustable power selector knob mounted to axially rotate in said opening, said knob having an integral locating element associated with said knob, said locating element being positioned within the interior of said main body and having a spiraling cam surface thereon; and (iii) said solenoid core having a cam folllower mounted adjacent to its upper end, said cam follower being fixed against rotation about the axis of said core, and being upwardly urged against said cam surface, said selector knob being selectively rotatable to rotate said cam surface thereby camming said core axially and adjusting the length of the axial stroke of said solenoid core between a maximum length staple driving stroke generating maximum power and a minimum length staple driving stroke generating minimum power.

2. The stapling tool of claim 1 wherein said power selector knob has two positions, one position providing for a maximum length maximum power solenoid core stroke, and the other position providing for a minimum length minimum power solenoid core stroke.

3. The stapling tool of claim 1 wherein said cam follower moves parallel to the axis of said main body.

4. The stapling tool of claim 1 wherein the power of said staple driver increases in correspondence with the increase in the selected length of the stroke of said solenoid core.

* * * * *